US006412837B2

(12) United States Patent
Futa

(10) Patent No.: US 6,412,837 B2
(45) Date of Patent: Jul. 2, 2002

(54) GRAPPLE

(75) Inventor: David M. Futa, South Bend, IN (US)

(73) Assignee: Magnetech Industrial Services, Inc., South Bend, IN (US)

( * ) Notice: Subject to any disclaimer, the term of this patent is extended or adjusted under 35 U.S.C. 154(b) by 0 days.

(21) Appl. No.: 09/749,366

(22) Filed: Dec. 28, 2000

Related U.S. Application Data

(63) Continuation of application No. 09/054,727, filed on Apr. 3, 1998, now Pat. No. 6,168,219, which is a continuation of application No. 08/693,972, filed on Aug. 8, 1996, now Pat. No. 5,762,388.

(51) Int. Cl.[7] ..... B66C 1/04; B66C 3/04

(52) U.S. Cl. ..... 294/3; 294/65.5; 414/606

(58) Field of Search ..... 294/1.1, 2, 3, 16, 294/50.5–50.9, 53.5, 55.5, 65.5, 67.31, 68.23, 86.4, 88, 104–109, 111, 112, 115; 37/182, 186, 187, 461; 414/606, 624, 739

(56) References Cited

U.S. PATENT DOCUMENTS

| | | | | |
|---|---|---|---|---|
| 762,759 A | | 6/1904 | Reuter | |
| 916,374 A | | 3/1909 | Schnabel | |
| 977,046 A | | 11/1910 | Schnabel | |
| 1,334,504 A | | 3/1920 | Parker | |
| 1,590,020 A | | 6/1926 | Golden | |
| 1,667,766 A | | 5/1928 | Bing | |
| 1,957,719 A | | 5/1934 | Naugle et al. | |
| 2,362,268 A | * | 11/1944 | Hall | 294/112 X |
| 2,651,538 A | | 9/1953 | Stahmer | |
| 2,761,094 A | | 8/1956 | Frampton | |
| 2,787,874 A | | 4/1957 | Blood et al. | |
| 2,850,189 A | | 9/1958 | Leroy | |
| 2,882,458 A | | 4/1959 | Anderson et al. | |
| 3,040,921 A | | 6/1962 | Davis | |
| 3,265,939 A | | 8/1966 | Rinderer | |
| 3,521,209 A | | 7/1970 | Fritz | |
| 3,559,130 A | | 1/1971 | Schrader | |
| 3,799,602 A | | 3/1974 | Laws et al. | |
| 4,248,471 A | * | 2/1981 | LaBounty | 294/106 X |
| 4,413,945 A | * | 11/1983 | LaBounty | 294/106 X |
| 5,024,397 A | * | 6/1991 | Edwards et al. | 294/68.23 |
| 5,078,214 A | * | 1/1992 | Holley | 294/107 X |
| 5,193,873 A | * | 3/1993 | Juliusz et al. | 294/106 |
| 5,257,871 A | * | 11/1993 | Zona et al. | 294/106 X |
| 5,299,845 A | * | 4/1994 | Gabriel | 294/2 |
| 5,411,304 A | | 5/1995 | Muto et al. | |

FOREIGN PATENT DOCUMENTS

| | | | | |
|---|---|---|---|---|
| DE | 1117281 | * | 11/1961 | 294/65.5 |
| DE | 2509003 | * | 9/1976 | 294/65.5 |
| DE | 3502552 | * | 9/1985 | 294/68.23 |
| EP | 0 224 002 | | 6/1987 | |
| EP | 0 411 227 | | 2/1991 | |
| JP | 07215661 | | 8/1995 | |

OTHER PUBLICATIONS

"Electricore 8 scrap lifting magnets," Catalog No. 6200D, Dings Co., magnet group, 4740 W. Electric Ave. Milwaukee, WI 53219 (12 pages).

"Welcome to Rotobec" advertising material dated Jun. 1993.

Rotobec literature with drawing "updated Jan. 1996".

European Search Report completed May 6, 1998, mailed Aug. 27, 1998.

* cited by examiner

*Primary Examiner*—Johnny D. Cherry
(74) *Attorney, Agent, or Firm*—Barnes & Thornburg

(57) ABSTRACT

A grapple provides a body and a tine. The tine has first and second ends and a plurality of arms located at the first end. The arms are separated by a pair of outer slots and at least one inner slot. The inner slot extends further into the tine relative to the pair of outer slots.

9 Claims, 3 Drawing Sheets

GRAPPLE

RELATED APPLICATIONS

The present application is a Continuation of U.S. patent application, Ser. No. 09/054,727 (filed Apr. 3, 1998), now U.S. Pat. No. 6,168,219, entitled *Grapple*, which is a Continuation of U.S. patent application, Ser. No. 08/693,972 (filed Aug. 8, 1996), entitled *Grapple*. To the extent not included below, the subject matter disclosed in these applications is hereby expressly incorporated into the present application.

FIELD OF INVENTION

The present disclosure relates to grapples, and, in particular, to grapples with magnetic properties.

BACKGROUND AND SUMMARY

Numerous grapples are known in the prior art. Such devices are used for gathering and moving material, often of irregular shape. For example, grapples may be used to gather scrap metal into a pile and then transport it to another location, such as for further processing. Examples of various grapples are shown in U.S. Pat. Nos. 762,759; 1,590,020; and 2,850,189.

Grapples of this sort often include a plurality of tines that may be moved to open the grapple. The open grapple may then be placed on top of the material to be gathered and the tines closed about the material so as to contain it. The grapple can then be moved to another location where the tines are opened to release the materials.

As the materials to be lifted and moved by the grapple are often of irregular size and shape and because the tines of the grapple, even when closed, do not form a complete enclosure, material that is initially gathered into the grapple sometimes falls out during transport. This may result in the deposit of material where it is not desired. This increases the amount of work to be performed, as the material that has fallen from the grapple must be gathered at a later point.

Accordingly, an illustrative embodiment of a grapple is provided. The grapple comprises a body and a tine. The tine comprises first and second ends and a plurality of arms located at the first end. The arms are separated by a pair of outer slots and at least one inner slot. The inner slot extends further into the tine relative to the pair of outer slots and the tine pivotally attached to the body. Other illustrative embodiments of the grapple include a magnetic coil wound about a portion of the tine. Another illustrative embodiment includes a first pair of tines each attached to the body such that the second end of each of the tines opposes one another. A second pair of tines may also be provided. Each of these tines is attached to the body such that the second end of each opposes one another. In addition, the second pair of tines may be positioned perpendicular relative to the first pair of tines.

Additional features and advantages of the grapple will become apparent to those skilled in the art upon consideration of the following descriptions.

BRIEF DESCRIPTION OF DRAWINGS

The illustrative embodiments will be described hereinafter with reference to the attached drawings which are given as non-limiting examples only, in which.

Corresponding reference characters indicate corresponding parts throughout the several views. The exemplification set out herein illustrates the embodiment of the grapple, in several forms, and such exemplification is not to be construed as limiting the scope of the grapple, in any manner.

DETAILED DESCRIPTION

Figure 1:
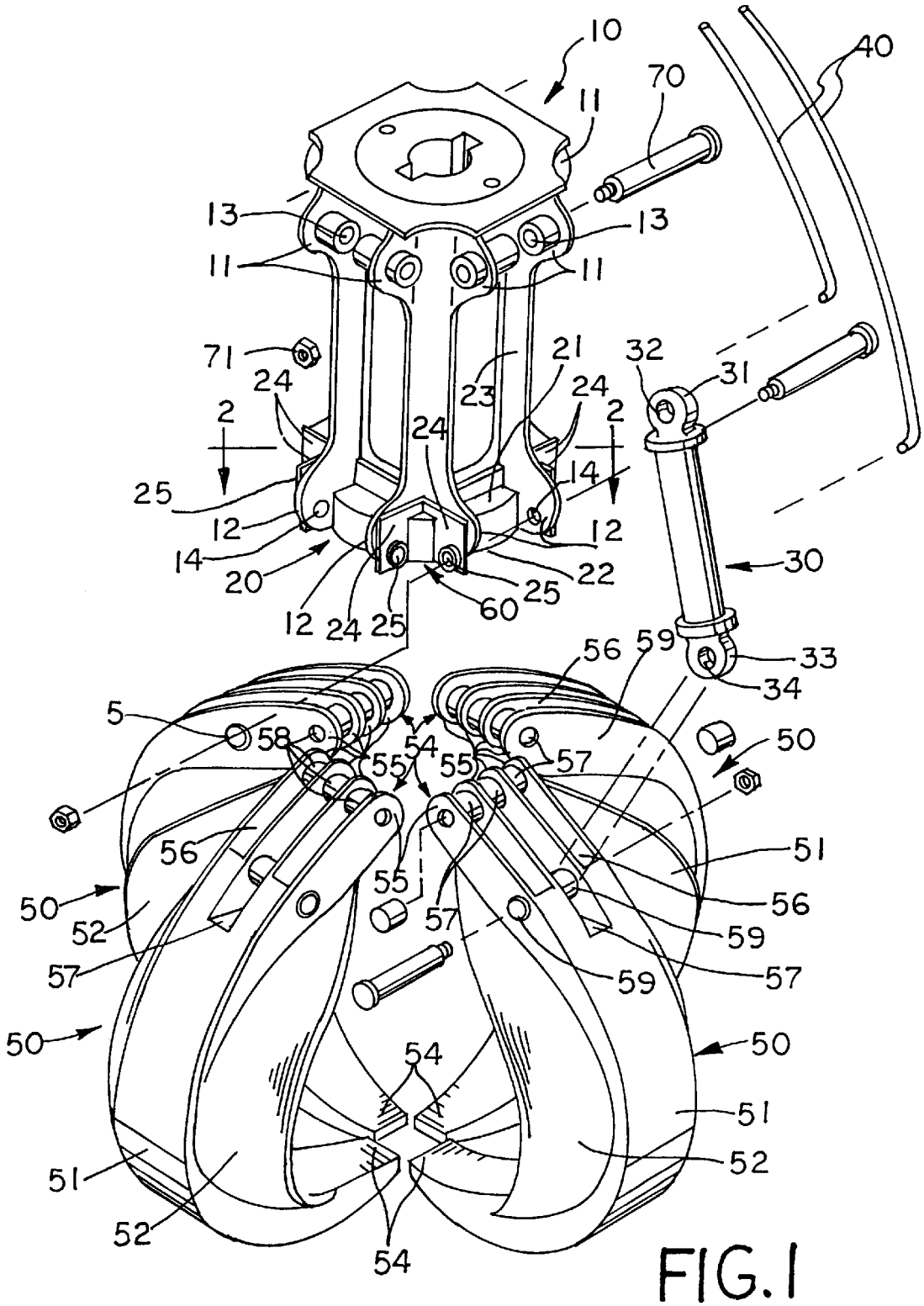
FIG. 1 is an exploded view of a grapple.

FIG. 1 is an exploded view of a grapple. The grapple generally comprises head assembly 10, ferrous body 20, cylinders 30, hoses 40, a plurality of tines 50 and magnetic coil 60.

Head assembly 10 includes a plurality of top ears 11 and bottom ears 12 spaced thereabout in pairs. Top ears 11 each include a hole 13 therethrough. Each bottom ear 12 includes a hole 14 therethrough. Top ears 11 and bottom ears 12 are used to secure cylinders 30 and tines 50, respectively, to head assembly 10 as described below.

Ferrous body 20 is generally located within the space defined by bottom ears 12 and includes a top surface 21, a bottom surface 22 and a continuous side surface 23. A plurality of ears 24 extend from ferrous body 20 and are arranged in pairs spaced evenly about ferrous body 20. One pair of ears 24 corresponds to each pair of bottom ears 12. Ears 24 each include a hole 25 therein. Holes 25 lie along the same axis as holes 14 in the corresponding pair of bottom ears 12.

Each cylinder 30 includes a top ear 31 having a hole 32 therein and a bottom ear 33 having hole 34 therein. Top ear 31 is placed between a pair of corresponding top ears 11 on head assembly 10 and a bolt or pin 70 is inserted through holes 13 and 34 and secured with a nut 71. In this manner, one end of cylinder 30 is secured to head assembly 10. Although only one cylinder 30 is shown, four would be used for the grapple shown, one for each tine 50. Hoses 40 are connected at one end to cylinders 30 and at the other end to a source of hydraulic fluid, as is known in the art, to operated cylinders 30.

Each tine 50 is a generally curved member, including a main portion 51, an outer skin 52, a first end 53 and a second end 54. At second end 54, each tine 50 is separated into a plurality of arms 55 separated by two outer slots 56 and one inner slot 57. Note that inner slot 57 in each tine 50 extends below the two outer slots 56. A hole 58 extends through each arm 55 at second end 54 of tines 50 and is in communication with slots 56 and 57. A second hole 59 extends through each tine 50 and is in communication with at least inner slot 57. Main portions 5l of tines 50 are preferably constructed from a 1020 steel. Outer skin 52 is preferably constructed from a nonferrous material.

Tines 50 are secured to head assembly 10 by positioning a pair of lower ears 12 within outer slots 56 in a tine 50 and inserting a bolt or pin 70 through holes 58 and 14 and securing with a nut 71. Bottom ear 33 of a cylinder 30 is inserted into inner slot 57 of tine 50 and secured thereto by inserting a bolt 70 through second holes 59 and hole 34 and securing with a nut 71.

When cylinders 30 are pressurized to extend them. bottom ears 33 will bear against the bolts or pins joining them to tines 50 and cause tines 50 to pivot inwardly. When cylinders 30 are depressurized to retract them, top ears 31 will pull on bolts or pins 70 joining them to tines 50,thereby opening tines 50.

Figure 2:
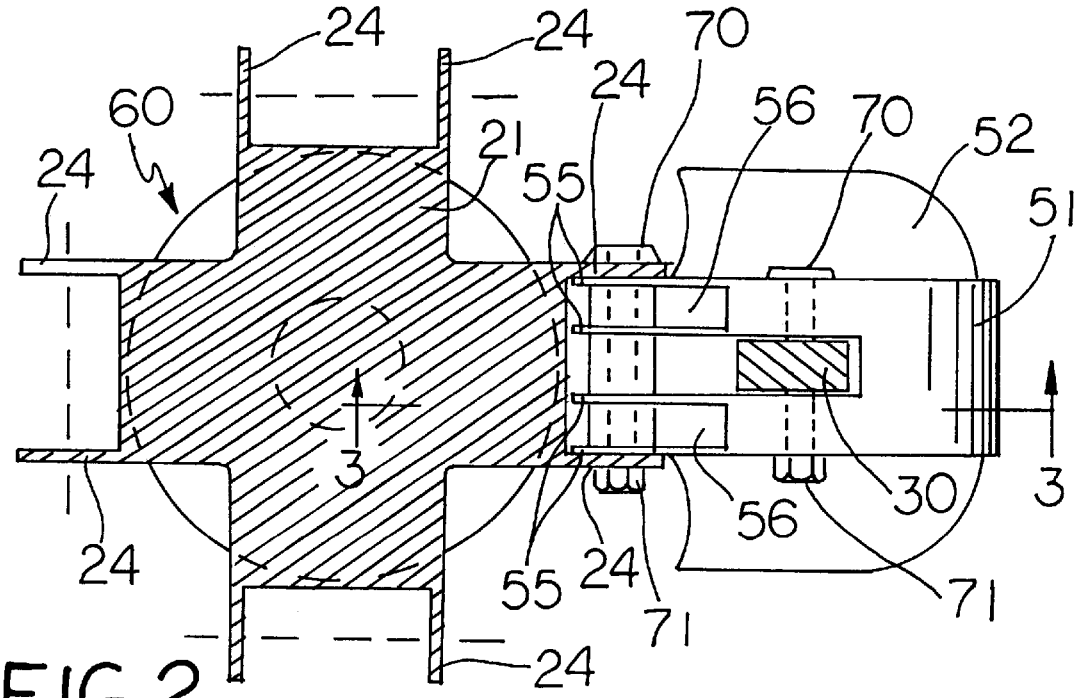
FIG. 2 is a cross-sectional view taken just above top surface 21 of ferrous body 20 in FIG. 1 with one tine 50 secured thereto.

FIG. 2 is a cross-sectional view taken just above top surface 21 of ferrous body 20 in FIG. 1 with one tine 50 secured thereto. FIG. 2 illustrates how ears 24 of ferrous body 20 straddle the outer-most arms 55 of tines 50, while bottom ears 12 of head assembly 10 are disposed between arms 55 within outer slots 56. FIG. 2 further shows how magnetic coil 60 is positioned relative to ferrous body 20.

Figure 3:
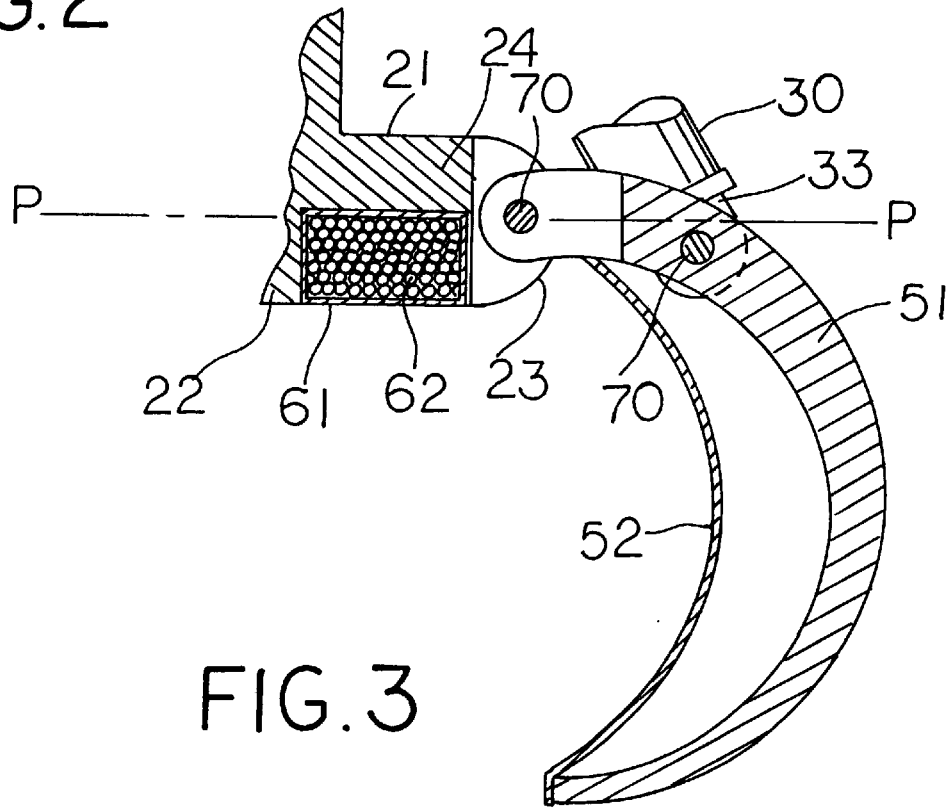
FIG. 3 is a cross-sectional view taken along line 3—3 FIG. 2.

FIG. 3 is a cross-sectional view taken along line 3—3 in FIG. 2. In this view, it can be seen that each tine 50 includes a central portion 51 disposed within outer skin 52. FIG. 3 further illustrates that magnetic coil 60 includes a non-ferrous casing or housing 61 surrounding coil 62. Magnetic coil 60 is positioned in ferrous body 20 such that a portion of ferrous body 20 forms the core of magnetic coil 60. Note also that magnetic coil 60 is positioned such that at least a portion of it lies in the same horizontal plane P—P as a portion of bolt or pin 70 that connects tine 50 to ferrous body 20. This positioning of magnetic coil 60 and tines 50 places magnetic coil 60 almost completely outside the area defined by tines 50, thereby providing a greater area which may be occupied by the material to be moved by the grapple.

Coil 62 is connected to a current source by any one of a number of means known in the prior art. When current is passed through coil 62, a magnetic field is generated within the space defined by tines 50. This field magnetizes ferrous body 20. Tines 50, being preferably manufactured from ferrous material, are likewise magnetized. Thus, tines 50 will be better able to gather ferrous items because of the magnetic field generated.

Figure 4:
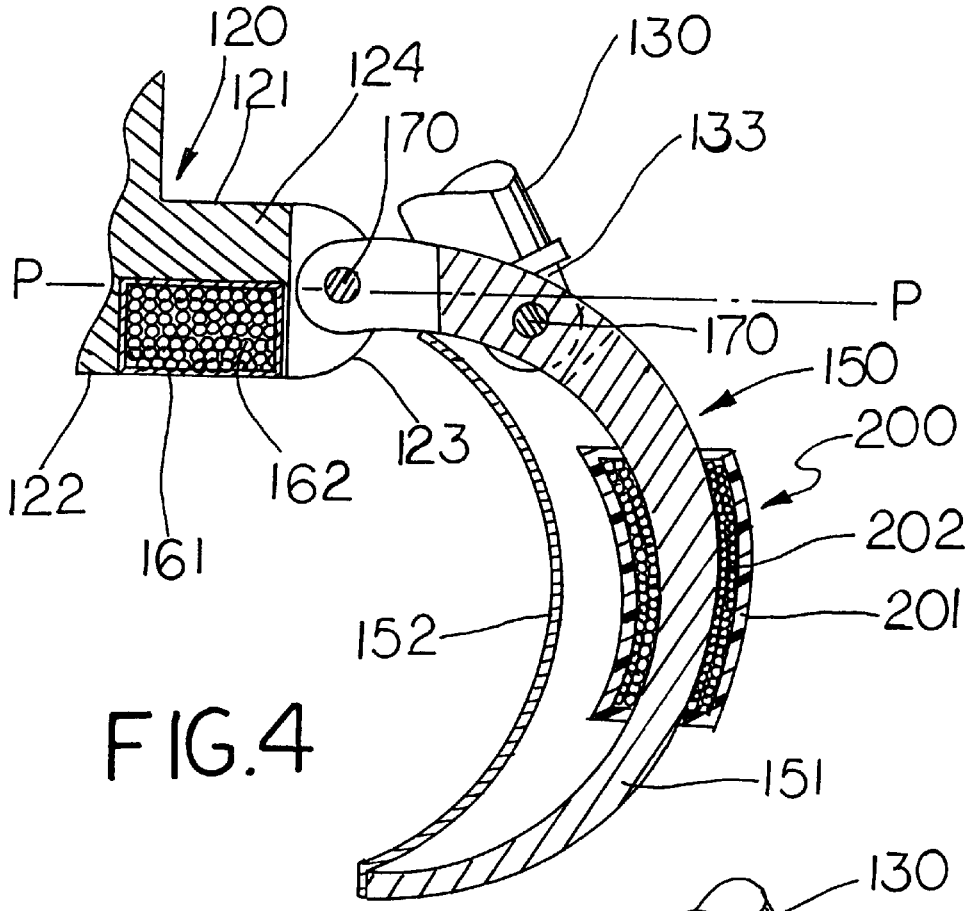
FIG. 4 is a cross-sectional view like that of FIG. 3 for an alternative embodiment of a grapple.

Another embodiment of the disclosure is shown in FIG. 4 wherein the numeral "1" has been added in front of the remainder of the numerical designation to indicate corresponding parts with the previous embodiment. In this embodiment, a magnetic coil 200 has ben added to tine 150. Magnetic coil 200 includes a non-ferrous shell or housing 201 containing coil 202. Coil 202 is wound about central portion 151 of tine 150. Central portion 151 is made from a ferrous material and forms the core of magnetic coil 202. Coil 202 is connected to a source of current by any suitable means shown in the prior art. When current is passed through coil 202, a magnetic field is generated within the area defined by the tines 150. The magnetic field also magnetizes tine 150. Such a magnet 200 may be added to as many tines 150 as desired. Note that in this embodiment, ferrous body 120 includes a housing 161 surrounding magnetic coil 162.

Figure 5:
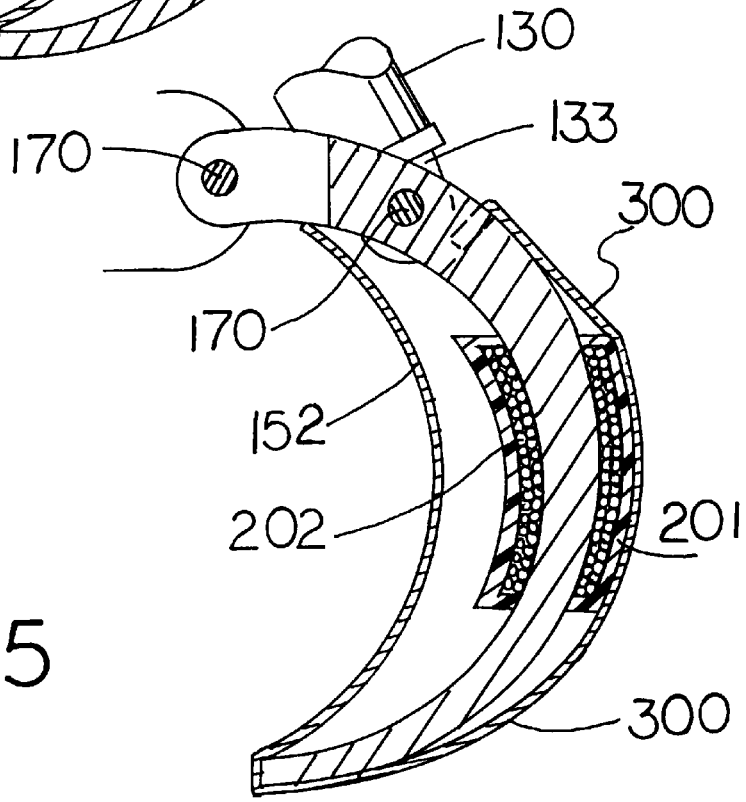
FIG. 5 is a cross-sectional view like that of FIG. 3 for an alternative embodiment of a grapple.

FIG. 5 shows yet another illustrative embodiment. This embodiment is the same as that shown in FIG. 4 except that an additional protective skin 300 has been added to the back of tine 150 to protect magnetic coil 200. Protective skin 300 is preferably made from a nonferrous material.

Although this illustrative embodiment has been shown and described in detail, it should be understood that the same is to be taken by way of example only and not by way of limitation. Numerous changes can be made to the illustrative embodiments without removing it from the scope thereof. For example, ferrous body 120 and magnetic coil 160 could be completely removed from the embodiment of FIG. 4. In such an embodiment, only magnetic coil 200, on one or more tines 150, would be utilized. Also, ferrous body 20 can be made in any desired shape. Any number of tines can be utilized and although they are preferably spaced evenly about the ferrous body, they do not have to be. The present disclosure can also be utilized with tines and head assemblies of configurations different from those illustrated. Accordingly, the scope of the present invention is to be limited only by the terms of the claims appended hereto.

What is claimed is:

1. A grapple, comprising:

a body; and a tine comprising first and second ends and a plurality of arms located at the first end, the arms are separated by a pair of outer slots and at least one inner slot, the inner slot extends further into the tine relative to the pair of outer slots, and the tine is pivotally attached to the body;

the tine comprises a magnetic coil;

the magnetic coil is wound about a portion of the tine; and the body includes a magnetic coil wound around a portion of the body.

2. The grapple according to claim 1, further comprising a first pair of tines and a second pair of tines each attached to the body such that the second end of each of the tines opposes one another, and the second pair of tines is positioned perpendicular relative to the first pair of tines.

3. A grapple, comprising:

a body; and at least a pair of tines pivotally attached to the body for opening and closing in relation to each other to gather and release material therebetween;

at least one of the tines having a magnetic coil wound around a portion of the tine, a magnetic coil wound around a portion of the body; and the at least one magnetic coil in the tine and the magnetic coil in the body producing a magnetic field therebetween.

4. The grapple according to claim 3, wherein the magnetic field generated by the coils flows from the body to the tine, through the tine and back to the body.

5. The grapple according to claim 3, wherein said magnetic coils are electromagnetic coils and are controllable to activate and deactivate the magnetic field.

6. The grapple according to claim 3, wherein the coil wound around a portion of the tines magnetizes the tine.

7. The grapple according to claim 3, wherein the tine has a front and a back and a protective skin is attached to the back of the tine generally overlying the magnetic coil.

8. The grapple according to claim 3, wherein each of the tines in the grapple includes a magnetic coil wound around a portion of the corresponding tines.

9. A grapple, comprising:

a body; and at least two pairs of two opposed tines pivotally attached to the body for opening and closing in relation to each other to gather and release material therebetween;

each of the tines having a magnetic coil wound around a portion of the tine, a magnetic coil wound around a portion of the body; and the magnetic coil in the tines and the magnetic coil in the body producing a magnetic field therebetween.

* * * * *